US009539166B2

(12) United States Patent
Wild et al.

(10) Patent No.: US 9,539,166 B2
(45) Date of Patent: Jan. 10, 2017

(54) COMPRESSION DEVICE FOR THE LIMB

(71) Applicant: Swelling Solutions, Inc., Minneapolis, MN (US)

(72) Inventors: David G. Wild, Wirral (GB); Jose A. Fernandez, Bridgend (GB); Ian S. Tabron, Cheshire (GB); Wayne L. Bonnefin, Chester (GB); Patrick G. Linnane, Chester (GB); David Kershaw, South Wirral (GB); Andrew D. Court, Neston Cheshire (GB); Paul Hanmer, Chester (GB)

(73) Assignee: Swelling Solutions, Inc., Minneapolis, MN (US)

( * ) Notice: Subject to any disclaimer, the term of this patent is extended or adjusted under 35 U.S.C. 154(b) by 208 days.

(21) Appl. No.: 14/204,595

(22) Filed: Mar. 11, 2014

(65) Prior Publication Data

US 2014/0194795 A1 Jul. 10, 2014

Related U.S. Application Data

(63) Continuation of application No. 10/811,014, filed on Mar. 26, 2004, now Pat. No. 9,044,372.

(30) Foreign Application Priority Data

Mar. 27, 2003 (GB) ..... 0307097.6

(51) Int. Cl.
*A61H 9/00* (2006.01)
*A61H 7/00* (2006.01)

(52) U.S. Cl.
CPC ..... *A61H 9/0007* (2013.01); *A61H 9/0071* (2013.01); *A61H 9/0078* (2013.01);
(Continued)

(58) Field of Classification Search
CPC ..... A61H 9/00; A61H 9/0071; A61H 9/0078; A61H 9/0009; A61H 7/001; A61H 2201/5056; A61H 2201/5074; A61H 2201/5007; A61H 2205/10; A61H 9/0007
See application file for complete search history.

(56) References Cited

U.S. PATENT DOCUMENTS 4,013,069 A 3/1977 Hasty
4,054,129 A 10/1977 Byars et al.
(Continued)

FOREIGN PATENT DOCUMENTS

EP 1018329 B1 7/2000
GB 2382988 6/2003
(Continued)

OTHER PUBLICATIONS

International Preliminary Report on Patentability issued Mar. 7, 2005 for International Patent Application No. PCT/GB2004/001336, filed Mar. 29, 2004.
(Continued)

*Primary Examiner* — Quang D Thanh
(74) *Attorney, Agent, or Firm* — Mueting, Raasch & Gebhardt, P.A.

(57) ABSTRACT

The invention provides a compression device for the limb of a mobile patient. The device includes an inflatable sleeve adapted to surround the limb; a conduit attached to the sleeve for delivering fluid to the sleeve; and a portable, wearable controller attached to the conduit that generates and controls the flow of fluid in the device.

20 Claims, 3 Drawing Sheets

Figure 1:
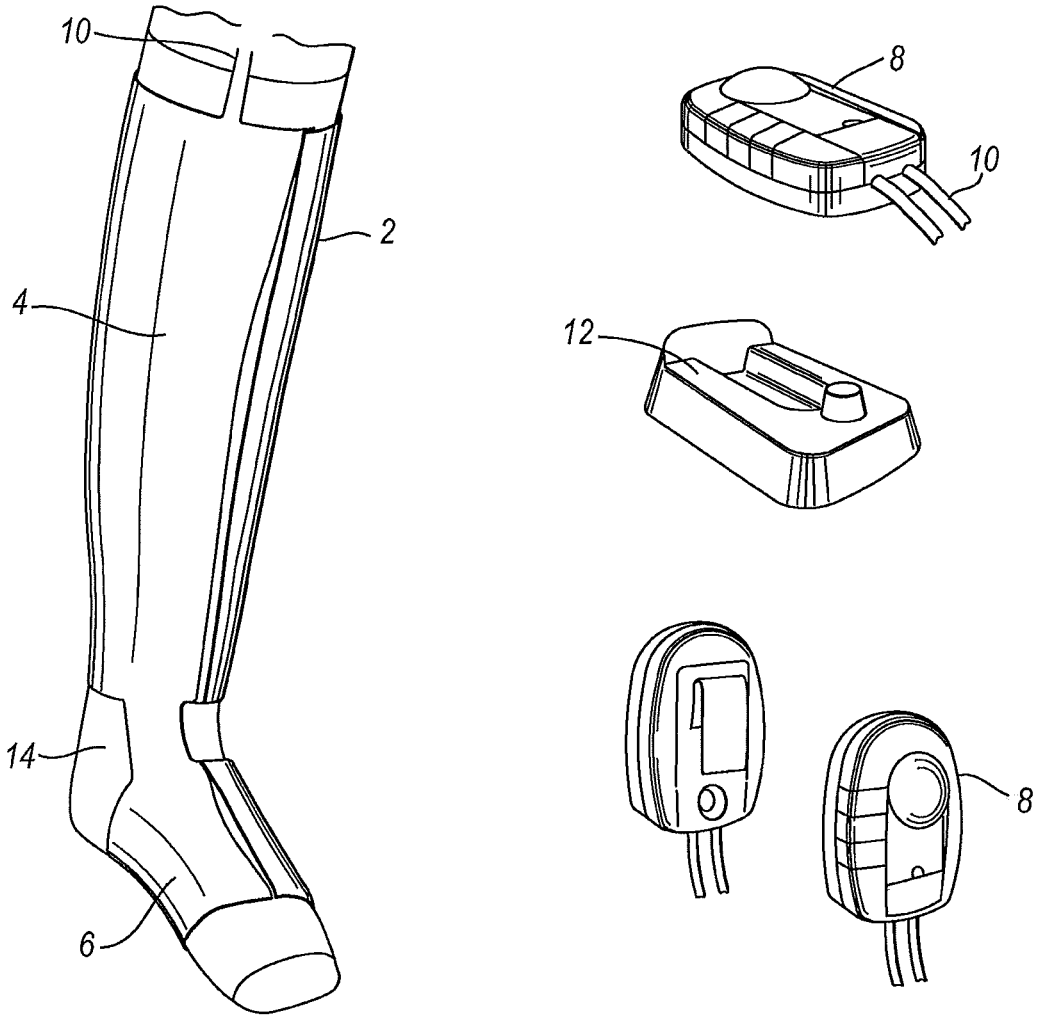

(52) U.S. Cl.
CPC ..... *A61H 7/001* (2013.01); *A61H 2201/5007* (2013.01); *A61H 2201/5056* (2013.01); *A61H 2201/5074* (2013.01); *A61H 2205/10* (2013.01)

(56) References Cited

U.S. PATENT DOCUMENTS

| | | | | |
|---|---|---|---|---|
| 4,091,804 | A | 5/1978 | Hasty | |
| 4,153,050 | A | 5/1979 | Bishop et al. | |
| 4,574,812 | A | 3/1986 | Arkans | |
| 4,597,384 | A | 7/1986 | Whitney | |
| 4,624,244 | A | 11/1986 | Taheri | |
| 4,702,232 | A | 10/1987 | Gardner et al. | |
| 4,938,208 | A | 7/1990 | Dye | |
| 4,941,458 | A | 7/1990 | Taheri | |
| 5,022,387 | A | 6/1991 | Hasty | |
| 5,117,812 | A | 6/1992 | McWhorter | |
| 5,139,475 | A | 8/1992 | Robicsek | |
| 5,186,163 | A | 2/1993 | Dye | |
| 5,263,473 | A | 11/1993 | McWhorter | |
| 5,383,894 | A | 1/1995 | Dye | |
| 5,437,610 | A | 8/1995 | Cariapa et al. | |
| 5,575,762 | A | 11/1996 | Peeler et al. | |
| 5,588,955 | A | 12/1996 | Johnson, Jr. et al. | |
| 5,591,200 | A * | 1/1997 | Cone | A61H 9/0078 601/152 |
| 5,626,556 | A | 5/1997 | Tobler et al. | |
| 5,843,007 | A | 12/1998 | McEwen et al. | |
| 5,876,359 | A | 3/1999 | Bock et al. | |
| 5,951,502 | A | 9/1999 | Peeler et al. | |
| 5,991,654 | A | 11/1999 | Tumey et al. | |
| 6,007,559 | A * | 12/1999 | Arkans | A61B 17/135 601/150 |
| 6,062,244 | A | 5/2000 | Arkans | |
| 6,123,681 | A | 9/2000 | Brown | |
| 6,198,204 | B1 | 3/2001 | Pottenger | |
| 6,231,532 | B1 | 5/2001 | Watson et al. | |
| 6,290,662 | B1 * | 9/2001 | Morris | A61H 9/0078 601/149 |
| 6,296,617 | B1 | 10/2001 | Peeler et al. | |
| 6,355,008 | B1 | 3/2002 | Nakao | |
| 6,440,093 | B1 | 8/2002 | McEwen et al. | |
| 6,463,934 | B1 | 10/2002 | Johnson, Jr. et al. | |
| 6,494,852 | B1 | 12/2002 | Barak et al. | |
| 6,544,202 | B2 | 4/2003 | McEwen et al. | |
| 6,558,338 | B1 | 5/2003 | Wasserman | |
| 6,589,194 | B1 | 7/2003 | Calderon et al. | |
| 6,620,116 | B2 | 9/2003 | Lewis | |
| 6,749,556 | B2 | 6/2004 | Banik | |
| 6,846,295 | B1 | 1/2005 | Ben-Nun | |
| 6,945,944 | B2 | 9/2005 | Kuiper et al. | |
| 6,988,423 | B2 | 1/2006 | Bolam et al. | |
| 7,001,384 | B2 | 2/2006 | Berish et al. | |
| 7,056,297 | B2 | 6/2006 | Dohno et al. | |
| 7,074,200 | B1 | 7/2006 | Lewis | |
| 7,354,410 | B2 | 4/2008 | Perry et al. | |
| 7,442,175 | B2 | 10/2008 | Meyer et al. | |
| 7,491,185 | B2 | 2/2009 | Couvillon, Jr. | |
| 7,618,384 | B2 | 11/2009 | Nardi et al. | |
| 7,637,879 | B2 | 12/2009 | Barak et al. | |
| 7,637,922 | B2 | 12/2009 | Johnson et al. | |
| 7,868,221 | B2 | 1/2011 | Munch-Fals et al. | |
| 7,992,217 | B2 | 8/2011 | Hyde et al. | |
| 8,029,451 | B2 | 10/2011 | Meyer et al. | |
| 8,079,969 | B2 | 12/2011 | Rousso et al. | |
| 8,079,970 | B2 | 12/2011 | Meyer et al. | |
| 8,100,841 | B2 | 1/2012 | Rousso | |
| 8,100,842 | B2 | 1/2012 | Rousso | |
| 8,105,252 | B2 | 1/2012 | Rousso | |
| 2001/0056250 | A1 | 12/2001 | Manor et al. | |
| 2004/0073146 | A1 | 4/2004 | Weintraub et al. | |
| 2004/0111048 | A1 | 6/2004 | Jensen et al. | |
| 2006/0074362 | A1 | 4/2006 | Rousso et al. | |
| 2006/0135894 | A1 | 6/2006 | Linnane et al. | |
| 2006/0287672 | A1 | 12/2006 | McEwen et al. | |
| 2008/0255494 | A1 | 10/2008 | Rousso et al. | |
| 2009/0018474 | A1 | 1/2009 | Nakao | |
| 2009/0118651 | A1 | 5/2009 | Rousso et al. | |
| 2010/0010404 | A1 | 1/2010 | Nardi et al. | |
| 2010/0010406 | A1 | 1/2010 | Nardi et al. | |
| 2010/0036299 | A1 | 2/2010 | Gough | |
| 2010/0204803 | A1 | 8/2010 | Tozzi et al. | |
| 2011/0009795 | A1 | 1/2011 | Graham et al. | |
| 2011/0066093 | A1 | 3/2011 | Vess | |
| 2011/0082401 | A1 | 4/2011 | Iker et al. | |
| 2011/0131839 | A1 | 6/2011 | Ballin et al. | |
| 2011/0196269 | A1 | 8/2011 | Arkans | |
| 2011/0245743 | A1 | 10/2011 | Eddy | |

FOREIGN PATENT DOCUMENTS

| | | |
|---|---|---|
| JP | 57-134159 | 8/1982 |
| JP | 52-142889 | 11/1997 |
| JP | 2001-514047 | 9/2001 |
| JP | 2002-521137 A | 7/2002 |
| JP | 2003-500167 | 1/2003 |
| JP | 2003-038603 | 2/2003 |
| WO | 99/11215 | 3/1999 |
| WO | 00/72797 | 12/2000 |
| WO | 2011/022305 A2 | 2/2011 |

OTHER PUBLICATIONS

Written Opinion mailed Aug. 3, 2004 for International Patent Application No. PCT/GB2004/001336, filed Mar. 29, 2004.

* cited by examiner

COMPRESSION DEVICE FOR THE LIMB

This application is a continuation patent application of U.S. patent application Ser. No. 10/811,014 filed on Mar. 26, 2004, which claims the benefit of priority of United Kingdom Patent Application No. 0307097.6, filed Mar. 27, 2003.

This invention relates to a compression device for the limb and particularly to a device for use on the leg. The device is particularly suited for use in the type of compression therapy used in the treatment of venous leg ulcers.

Various compression devices are known for applying compressive pressure to a patient's limb. These types of devices are used to assist mainly in the prevention of deep vein thrombosis (DVT), vascular disorders and the reduction of oedema. Prior art devices are adapted for use in a hospital setting in which they are used predominantly for the prevention of DVT in patients with a high risk for developing the same. U.S. Pat. No. 5,117,812, U.S. Pat. No. 5,022,387 and U.S. Pat. No. 5,263,473 (The Kendall Company), U.S. Pat. No. 6,231,532 (Tyco International Inc), U.S. Pat. No. 6,440,093 (McEwen et al) and U.S. Pat. No. 6,463,934 (Aircast Inc) disclose such devices.

Compression therapy is used in the treatment of venous leg ulcers. The treatment relies on the compression achieving a reduction in oedema and improved return of blood via the venous system. This in turn reduces the residence time for blood supplied to the lower limb and the severity of ischaemic episodes within the limb that can result in tissue breakdown.

Compression of the limb in the treatment of venous leg ulcers is most usually achieved by the use of elastic bandages. Elastic bandages have the advantages that the patient can be mobile, can be treated at home and that once applied by a health care professional any removal or interference is easily detected. Elastic bandages do however have many disadvantages.

They can work loose, the pressure generated by the bandage on the limb is not measured and depends on the level of skill of the health care professional applying the bandage, the level of compression depends on the circumference of the limb, the bandage cannot be removed and reapplied by the patient, for instance for bathing, and many patients find them unsightly, uncomfortable, hot or painful. The actual pressure is inversely proportional to the radius of the limb, so that pressure is unevenly distributed, and low pressure spots occur in depressions, such as those around the ankle. High pressure occurs at the ankle and shin bones, where the radius under the bandage is reduced.

Compression of the limb in the treatment of venous leg ulcers can also be achieved by the use of compression stockings, although they are most often used in the prevention of leg ulcers for instance in the prevention of recurrence after an active leg ulcer has healed. Compression stockings have many of the advantages of elastic bandages, they can be used at home and the patient can be mobile. They however have some disadvantages. They are difficult to apply as the narrow ankle part has to be pulled over the heel, compliance with treatment is difficult to monitor as the patient may be able to remove and replace the stocking themselves and patients can find them uncomfortable. As with bandages, the actual pressure is inversely proportional to the radius of the limb, so that pressure is unevenly distributed, and low pressure spots occur in depressions, such as those around the ankle. High pressure occurs at the ankle and shin bones, where the radius under the bandage is reduced.

Compression of the limb can also be achieved by a pneumatic compression device. As explained above, known devices are predominantly used in the treatment of DVT where the patient is immobile and in hospital and as a consequence the devices are not adapted to the different needs of the venous leg ulcer patient. As venous leg ulcers are most usually treated at home or in the community and the known compression devices are large, heavy and require professional supervision, their adoption for such treatment has not been widespread. In addition most pneumatic compression devices require mains power which severely restricts patient mobility. This is undesirable and unnecessary. Further because the known compression devices are designed to be used on an immobile patient, they are not adapted to the challenges of a mobile patient who stands, walks, sits or lies down and thereby affects the pressure in the device. The known devices apply pressure to the limb through a thick cuff or cuffs which affect patient mobility and are aesthetically unacceptable to many patients. The pump that produces the compression is large and heavy and can supply fluid to the cuffs through many pipes. These characteristics make the known devices unsuitable for domestic use. It is believed that immediate mobilisation under compression post-surgery is beneficial in prevention of DVT, and existing pneumatic compression devices are unsuitable because of their size and weight, restricting patients to their beds while the treatment is applied.

Pneumatic compression devices do however have advantages. They provide an effective treatment, while deflated, the inflatable cuff or cuffs are easy to apply to the patient's leg and the pressure is more readily controlled and monitored. Also they are not subject to the effect of radius, which is a fundamental limitation of elasticated bandages and stockings. Under a pneumatic compression device, the air within a single compartment applies an even level of pressure in the vicinity of shin or ankle bones, or in the depressions around these bony prominences.

There thus exists a need for a device for use in the treatment of venous leg ulcers and other clinical conditions where compression has therapeutic benefits that overcomes the disadvantages of elastic bandages or stockings, that has the advantages of pneumatic compression but not the disadvantages of the known pneumatic devices. A small, ambulant, portable device is thus needed.

We have now invented a device for applying compressive pressures against a patient's limb which alleviates the above problems by providing a low profile, portable device which is simple to apply to the limb and is small and lightweight. A first aspect of the present invention provides a compression device for the limb comprising:

an inflatable sleeve adapted to surround the limb a conduit attached to the sleeve for delivering fluid to the sleeve and a a portable, wearable controller attached to the conduit that generates and controls the flow of fluid in the device.

We have found that such a device brings the advantages of pneumatic compression to leg ulcer patients and other clinical conditions where compression has therapeutic benefits.

Preferably the controller 8 comprises a microprocessor control system 26 and a pump 28. More preferably the device comprises at least one pressure sensor attached to the sleeve and located between the sleeve and the limb or positioned internally in the sleeve, the sensors providing readings of the pressure experienced by the limb due to the inflation of the sleeve by the controller.

We have found that monitoring the actual pressure experienced by the limb due to the device enables the device to provide a predetermined compression profile to the limb. The predetermined compression profile may be selected by the health care professional to cater for the patient's condition. For example, a patient with lymphodema requires a higher level of compression than a patient with a healed leg ulcer. The sensor also allows the device to increase or decrease the pressure on a particular part of the limb to give the predetermined compression profile while the device is in use. This alleviates the problem of pressure difference experienced with the use of elastic bandages where the pressure depends on the tension in the bandage, the amount of overlap and the shape of the leg of the patient.

Preferably the sleeve comprises one or more individually inflatable cells. More preferably a sensor is associated with each cell to monitor the pressure experienced by the limb due to pressure from that cell. This allows the device to precisely control the pressure in each cell and thus comply with the predetermined compression profile. It also allows the device to operate a peristaltic compression.

The provision of individual cells in the sleeve and sensors that constantly monitor pressure exerted by the sleeve allows the device to be dynamic in that the controller can detect when a patient is standing and then sits or is sitting and then stands and walks. The level of compression that is required is higher when the patient is standing rather than sitting because of the effect of gravity which increases venous pressure in the limb. Thus when the patient stands, the controller inflates the sleeve to achieve the preset compression profile on the limb. An advantage of this dynamic feature of the device is that the effectiveness of venous return is maintained whatever the patient does.

Due to the sensors and monitoring capacity of the device and the microprocessor present in the controller, it is possible to monitor the usage of the device by the patient. This is not possible with elastic compression devices. Knowledge of the extent of usage will enable the health care professional to prescribe the most suitable treatment for the next stage of healing or prevention.

The capability of the controller to deliver predetermined compression profiles to the limb also enables the health care professional to give the patient some control over their treatment. For a chosen treatment regime the patient can select a high compression or low compression setting. This alleviates the problem of non-compliance in some patients who cannot tolerate the pain of compression bandages or stockings that only provide one compression level. The use of the device on a low setting is preferable to rejection of the treatment altogether.

This capability also allows the level of compression to be varied from patient to patient. For instance a patient with superficial disease may be treated effectively by a low level of compression whereas a patient with deep vein disease may need a higher level of compression. Similarly a patient with severe oedema may require a higher level of compression in the gaiter area than one without oedema. It is possible to provide the pressure profile needed to treat these various indications through the use of a device according to the invention.

Preferably the sleeve is low profile and discrete. This allows the patient to use the device wearing ordinary clothes and shoes.

Preferably the sleeve comprises a leg cuff and a foot cuff both of which are low profile and discrete. More preferably the leg and foot cuffs are anatomically shaped to provide compression on those parts of the leg or foot which have the greatest effect on blood flow. This gives the advantage of reducing the overall size of the device and thus the profile of the cuff and size and power of the pump. Depending on the shape of the cuffs it can also reduce discomfort from pressure on bony areas of the limb.

Preferably the leg cuff comprises three cells formed from plastic or rubber capable of being inflated to a predetermined pressure. These are a gaiter cell located closest to the ankle, a mid-calf cell located above the gaiter cell and an upper cell located between the mid-calf cell and the knee. In a specific embodiment of the device, each cell wraps around the lower limb but is contained within the leg cuff.

We have found that the gaiter cell can have two main functions. Firstly it has the greatest effect on subcutaneous oedema reduction and can be set at a relatively high pressure when oedema is present. We have also found that this cell has the greatest effect on reducing venous reflux in patients with venous insufficiency. This cell also provides resistance against the calf muscle pump.

We have found that the mid-calf cell has the effects of reducing venous reflux and increasing the pumping efficiency of the calf muscle. This cell is designed to act as an inflexible restraint on the calf muscle pump, so that when the pump is activated (e.g. during walking) venous blood is squeezed out of the lower leg towards the heart, even when the patient has venous insufficiency caused by ineffective valves in the veins. This cell can be maintained at a lower pressure when the patient is at rest.

We have found that the upper calf cell reduces reflux when the calf muscle is at rest. When the calf muscle contracts the volume of muscle at this part of the leg is reduced meaning that this cell applies a reduced pressure. The cell thus does not restrict the outflow of blood during contraction. When the calf muscle relaxes however, the volume of muscle in the region of this cell expands, causing the cell to apply full pressure. This reduces venous backflow.

The upper calf cell and the mid-calf cell alternate in providing compression so that the mid-calf cell provides higher compression when the blood is being expelled from the leg and the upper calf cell provides higher compression to prevent backflow at rest. The mid-calf cell resists dilation of the superficial veins at all times.

The foot cuff preferably comprises a cell formed from plastic or rubber that applies compression to the instep of the foot. The foot cell minimises the volume of blood in the region to help circulation of blood back into the venous return system.

The four cell design according to one aspect of the invention provides the local control needed to effectively treat venous insufficiency. A separate upper cell is needed because its pressure is out of phase with the mid-calf cell and gaiter cell. A separate gaiter cell is needed because the gaiter cell must provide the variation in pressure required for patients with varying levels of oedema. The mid-calf cell needs only to provide resistance and can be at a lower pressure when the patient is at rest. A separate foot cell is needed because otherwise pressure spikes may occur when the patient walks affecting the control of the other cells. These effects could of course be provided by more than four cells and such devices are considered within the scope of the present invention.

The device according to the invention preferably comprises a pump. Such a device suffers from the disadvantage that the noise of the pump can be embarrassing for the patient and lead to non-compliance with the treatment or therapy. The device according to the invention may be used in a silent mode where the pump is disabled and all valves are kept closed. In this mode the device still applies compression but if the pressure falls after a period of time in silent mode the device does not operate the pump to compensate. When next able the patient can switch the device out of silent mode and reactivate the pump.

Figure 2:
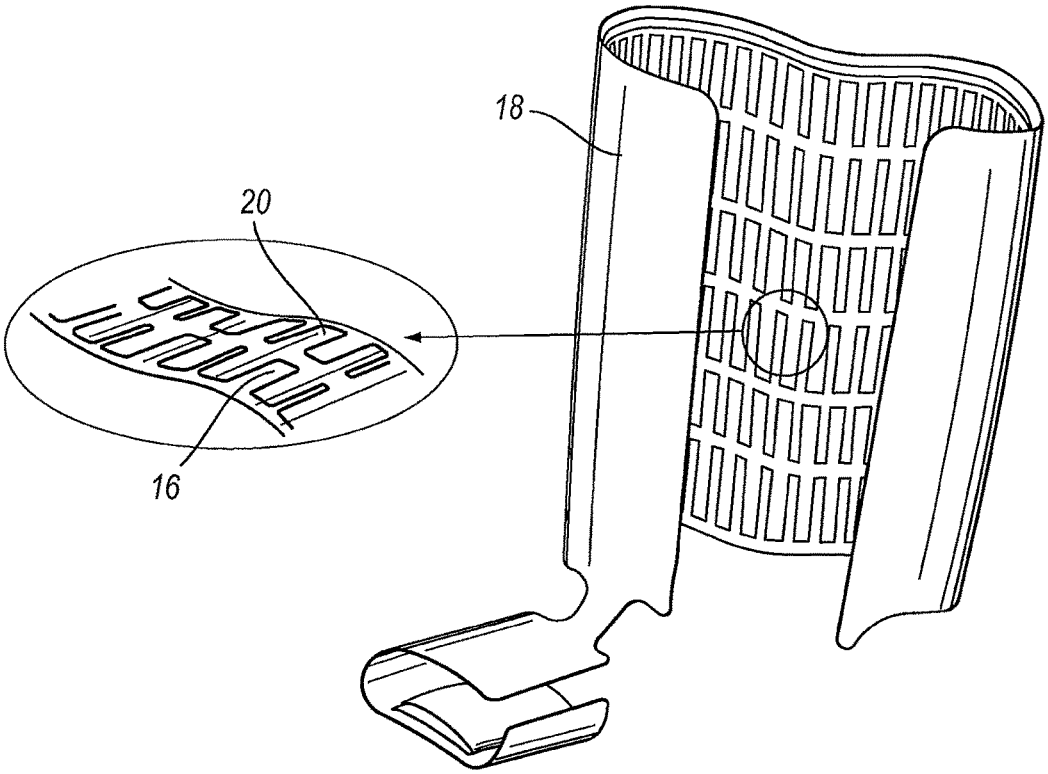
Figure 3:
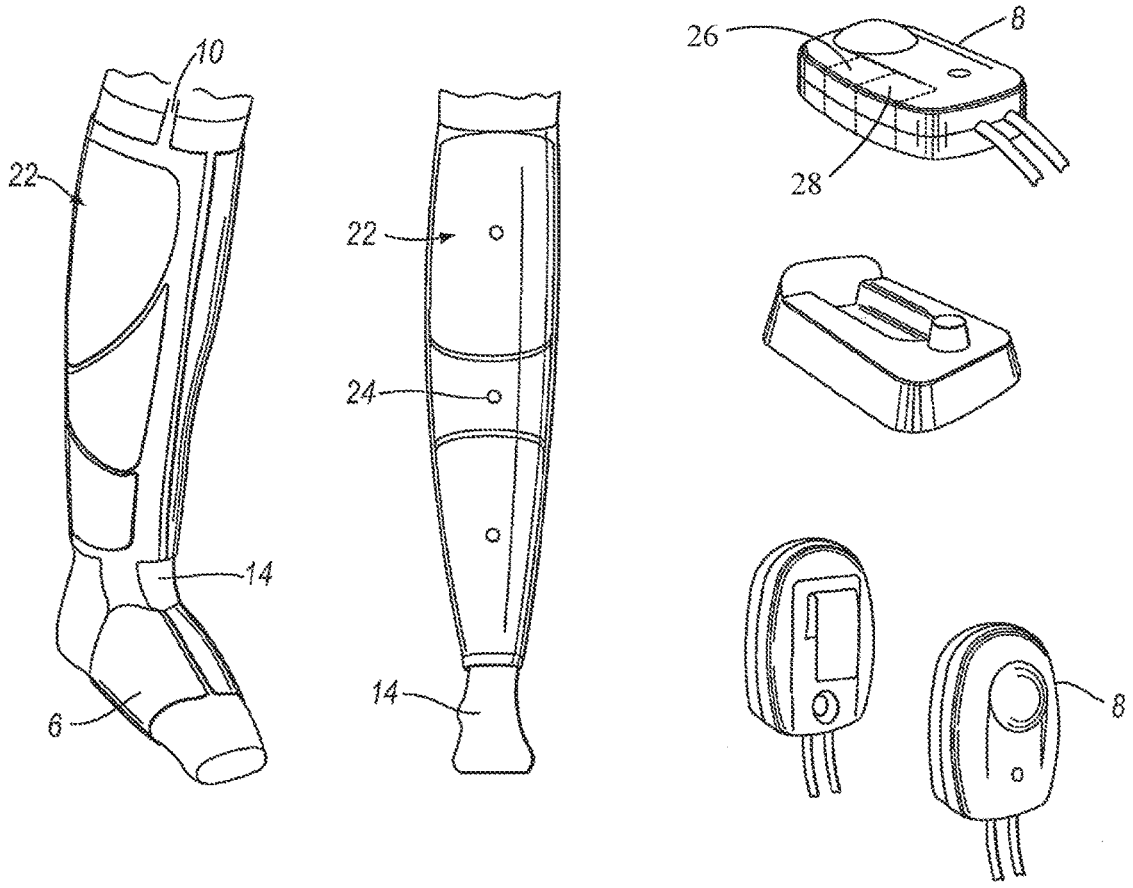

Preferred embodiments of the invention will now be described with reference to the accompanying drawings in which:

FIG. 1 is a perspective view of the sleeve of the device on the limb and the controller, FIG. 2 is a perspective view of the sleeve of the device off the limb and opened up and FIG. 3 is a perspective view of the sleeve and controller of a second embodiment of the device on the limb.

In FIG. 1 the compression device of the invention is shown on the leg of a patient in a standing position. The device comprises a sleeve 2 having a leg cuff 4 connected to a foot cuff 6. The sleeve 2 is connected to a controller 8 by a conduit 10. The controller is a small, hand held unit that is attached to the sleeve or to the waistband of the patient's trousers or skirt. The controller is battery powered and rechargeable so that it can be recharged on the base unit 12. The device also comprises a sock 14 worn between the patient's leg and the sleeve 2. The sock is present to absorb any moisture from the patient's leg but does not apply compression. The sleeve 2 has an inner 16 and an outer 18 surface composed of a durable flexible material that can be sponged clean and is divided into a plurality of cells 20 best seen in FIG. 2.

FIG. 3 shows an alternative embodiment of the device of the invention where the leg cuff and foot cuff comprise cells with an anatomical shape 22. Each cell is provided with a sensor located centrally in each cell but on the inside of the sleeve between the sleeve and the leg. In FIG. 3 the sleeve is marked on the outside at a position corresponding to the position of the sensor in the inside of the sleeve at 24. The foot cuff in either embodiment may have a sensor located in a position corresponding to the instep of the foot.

FIG. 3 shows the cell structure of the device with a foot cell around the foot, a gaiter cell located closest to the ankle, a mid-calf cell located above the gaiter cell and an upper cell located between the mid-calf cell and the knee.

As can be seen in both embodiments of the device, the patient puts the sleeve on by wrapping the leg cuff and the foot cuff around the leg or foot and securing them at the front of the limb where it is most bony. In this way pressure is applied by the sleeve where it is most needed, i.e. not on the bony areas of the limb but over the muscles.

The invention will now be illustrated by the following non-limiting examples.

EXAMPLE 1

A four cell device similar to that shown in FIG. 3 was used to apply controlled compression to the foot and calf areas of the lower leg. Patients were recruited to test the device on the basis that they had superficial venous insufficiency that had been present for six weeks or longer.

The device was evaluated by measuring the time in seconds for the veins to refill to a level resulting in 90% of a pre-exercise venous pressure (RT90) with and without the device. The pressure was measured in the saphenous vein at the ankle using an Elcat Vasoquant VQ4000 while compression was applied to different regions of the lower leg. In each cycle of the experiment a different compression profile was set up and the pressure measured while the subject bent the knee with heels on the floor 20 times in 40 seconds. This action pumps blood from the veins reducing the venous pressure. The final venous pressure after the last knee bend is the ambulatory venous pressure (AVP). The patient then stood still and the blood flowed back into the legs. The time taken for the venous pressure to reach 90% of the resting level was recorded (RT90).

The RT90 result from a healthy control subject with no compression from the device was 28 seconds. The AVP for this person was 24 mm Hg. The RT90 for a patient with superficial venous insufficiency with no compression from the device was 10.5 seconds. The AVP for this patient was 26 mm Hg. The device to be successful must increase the RT90 of a patient towards that of a healthy control subject. For instance in this case increase the RT90 from 10.5 towards 28 seconds. Compression was applied to the patient with 12 mm Hg in the foot cell, 48 mm Hg in the gaiter and mid-calf cells and 12 mm Hg in the upper cell. The RT90 for this patient increased to 27.5 seconds (very close to the level of a healthy control) and the AVP decreased to 21.5 mm Hg.

In the study, the device was effective in increasing RT90 or reducing AVP at this level of compression in 54% of patients. The device could be effective in higher numbers of patients at higher levels of compression.

EXAMPLE 2

In the experiment of Example 1 it was found that in patients that responded, the gaiter cell had the strongest effect on RT90. This proves that pressure in the gaiter cell reduces reflux. It was also found that the gaiter cell caused the greatest reduction in skin pressure during the knee bends possibly indicating that this cell has the strongest effect on oedema reduction. It was also found that this cell provides resistance to the lower part of the calf muscle, improving pumping efficiency.

EXAMPLE 3

In the experiment of Example 1 it was found that in patients that responded, the mid-calf cell had the second strongest effect on RT90 proving that pressure in this region reduces reflux. It was also found that this cell provides resistance to the calf muscle improving pumping efficiency.

EXAMPLE 4

In the experiment of Example 1 it was found that in patients that responded, the upper cell increases RT90 but only when the gaiter cell is pressurised. The resistance provided by this cell reduces when the venous pressure peaks. However as the calf muscle pump relaxes, it is believed that this cell reduces reflux by constricting the vein.

EXAMPLE 5

In the experiment of Example 1, it was found that the foot cell increases RT90 but only when the gaiter cell is pressurised.

Although the present invention has been shown and described with respect to several preferred embodiments thereof, various changes, omissions and additions to the form and detail thereof, may be made therein, without departing from the spirit and scope of the invention.

The invention claimed is:

1. A compression device for the limb of a mobile patient comprising:

an inflatable sleeve adapted to surround the limb;

a conduit attached to said sleeve for delivering fluid to said sleeve; and a portable, wearable controller attached to said conduit that generates and controls the flow of fluid in the device, the controller comprising a microprocessor control system and a pump, wherein the device is configured to provide compression to the limb using the inflatable sleeve and configured to provide a patient controlled silent mode, wherein the device applies compression with the pump disabled when in the silent mode and the device does not operate the pump to compensate for a pressure fall after a period of time when in the silent mode, and wherein the patient can switch the device out of silent mode and reactivate the pump.

2. The compression device as claimed in claim 1, wherein said sleeve includes one or more individually inflatable cells.

3. The compression device as claimed in claim 1, wherein said sleeve includes a leg cuff and a foot cuff.

4. The compression device as claimed in claim 3, wherein said leg cuff includes at least three cells.

5. The compression device as claimed in claim 1, wherein said controller is battery operated.

6. The compression device as claimed in claim 2, wherein each cell is monitored by a sensor.

7. The compression device as claimed in claim 4, wherein said cells include a gaiter cell, adapted to wrap around the lower limb in the region closest to the ankle, a mid-calf cell, adapted to wrap around the lower limb above the region occupied by the gaiter cell and an upper cell adapted to wrap around the lower limb in the region between the mid-calf cell and the knee.

8. The compression device as claimed in claim 4, wherein said cells are pressurized to the same or different predetermined pressures.

9. A compression device for the limb of a mobile patient comprising:

an inflatable sleeve adapted to surround the limb;

a conduit coupled to said sleeve for delivering fluid to said sleeve; and a portable, wearable controller coupled to said conduit that generates and controls the flow of fluid, the controller comprising a microprocessor control system and a pump, wherein the controller is configured to allow a patient to selectively operate the device in dynamic compression in which the pressure is monitored during use to provide the dynamic compression and maintain a preset compression profile on the limb and operate the device in a silent mode, wherein the device applies compression with the pump disabled when in the silent mode and the device does not operate the pump to compensate for a pressure fall after a period of time when in the silent mode.

10. The compression device as claimed in claim 9, wherein the device is configured to allow the patient to switch the device out of silent mode and reactivate the pump.

11. The compression device as claimed in claim 9, wherein said sleeve includes one or more individually inflatable cells.

12. The compression device as claimed in claim 9, wherein said sleeve includes a leg cuff and a foot cuff.

13. The compression device as claimed in claim 9, wherein said controller is battery operated.

14. The compression device as claimed in claim 11, wherein each cell is monitored by a sensor.

15. A compression device for the limb of a mobile patient comprising:

an inflatable sleeve adapted to surround the limb;

a conduit coupled to said sleeve for delivering fluid to said sleeve; and a portable, wearable controller coupled to said conduit that generates and controls the flow of fluid, the controller comprising a microprocessor control system and a pump, wherein the device is configured to provide compression to the limb using the inflatable sleeve and the device is configured to provide a patient controlled silent mode, wherein the pump is disabled and all valves are kept closed when in the silent mode.

16. The compression device as claimed in claim 15, wherein the controller is configured to allow a patient to selectively operate the device in dynamic compression in which the pressure is monitored during use to provide the dynamic compression and maintain a preset compression profile on the limb or operate the device in the silent mode in which the device applies compression but if the pressure falls after a period of time the device does not operate the pump to compensate.

17. The compression device as claimed in claim 15, wherein said sleeve includes one or more individually inflatable cells.

18. The compression device as claimed in claim 15, wherein said sleeve includes a leg cuff and a foot cuff.

19. The compression device as claimed in claim 15, wherein said controller is battery operated.

20. The compression device as claimed in claim 15, wherein each cell is monitored by a sensor.

* * * * *